US006908000B2

(12) United States Patent
Craft et al.

(10) Patent No.: US 6,908,000 B2
(45) Date of Patent: Jun. 21, 2005

(54) MULTI-TIERED CORNER SHELVING UNIT

(75) Inventors: Charles W. Craft, Apple Creek, OH (US); David M. Stitchick, Wooster, OH (US)

(73) Assignee: Rubbermaid Incorporated, Wooster, OH (US)

( * ) Notice: Subject to any disclaimer, the term of this patent is extended or adjusted under 35 U.S.C. 154(b) by 0 days.

(21) Appl. No.: 10/360,975

(22) Filed: Feb. 7, 2003

(65) Prior Publication Data

US 2003/0173321 A1 Sep. 18, 2003

Related U.S. Application Data

(60) Provisional application No. 60/355,515, filed on Feb. 7, 2002.

(51) Int. Cl.[7] ..... A47F 5/02

(52) U.S. Cl. ..... 211/144; 211/78; 211/163

(58) Field of Search ..... 211/95, 78, 70, 211/163, 144, 188, 166, 134, 196, 175; 108/94, 95, 147.11–147.15, 106, 139, 107, 144.11; 312/125, 135, 34.2, 59, 249.2, 197, 266, 267, 97.1; D6/562, 455, 468, 469

(56) References Cited

U.S. PATENT DOCUMENTS

| | | | | | |
|---|---|---|---|---|---|
| 456,728 | A | * | 7/1891 | Lamson | 312/135 |
| 1,687,149 | A | | 10/1928 | Shauer et al. | 108/94 |
| 1,754,094 | A | | 4/1930 | Glass, Sr. | 312/305 |
| 3,858,529 | A | * | 1/1975 | Salladay | 108/103 |
| 4,191,437 | A | | 3/1980 | Funke | |
| 4,269,124 | A | | 5/1981 | Rosenthal et al. | 108/103 |
| D267,211 | S | * | 12/1982 | Farrell | D6/468 |
| 4,643,104 | A | | 2/1987 | Rasmussen | 108/105 |
| 4,700,850 | A | | 10/1987 | Morgan et al. | 211/131 |
| 4,760,800 | A | * | 8/1988 | Hanson | 108/190 |
| 4,796,960 | A | | 1/1989 | Candelas | 312/305 |
| 4,823,966 | A | | 4/1989 | Haber | 211/128 |
| 4,930,643 | A | * | 6/1990 | Flum | 211/188 |
| 4,976,359 | A | | 12/1990 | Hardy | 211/58 |
| 5,257,703 | A | * | 11/1993 | Ascik et al. | 211/166 |
| 5,641,080 | A | | 6/1997 | Humphrey et al. | 211/77 |
| 5,669,494 | A | | 9/1997 | Geffen | 206/308.1 |
| D388,992 | S | * | 1/1998 | Weisburn et al. | D6/562 |
| 5,709,158 | A | * | 1/1998 | Wareheim | 108/186 |
| 5,799,787 | A | | 9/1998 | Talbot | 206/308.1 |
| D403,903 | S | | 1/1999 | Calmeise | D6/511 |
| D406,713 | S | | 3/1999 | Houk, Jr. et al. | D6/511 |

(Continued)

OTHER PUBLICATIONS

PCT International Written Opinion issued in PCT/US03/03835, mailed Dec. 4, 2003.

PCT International Preliminary Examination Report (IPER) issued in PCT/US03/03835 on Apr. 2, 2004.

*Primary Examiner*—Jennifer E. Novosad
(74) *Attorney, Agent, or Firm*—Marshall, Gerstein & Borun LLP

(57) ABSTRACT

A modular corner shelving system has a plurality of panels arranged vertically stacked and spaced apart. Each panel has an upper surface, a pair of back edges, a back corner, at least one front edge, and a plurality of sockets. One of the sockets is a rear socket positioned near the back corner. Each socket defines a top receptacle accessible from the upper surface and a bottom receptacle accessible from beneath the panel. A plurality of elongate risers each have a lower end received in a top receptacle of one of the sockets of one panel and an upper end received in a bottom receptacle of a corresponding one of the sockets of an adjacently upward panel. The system can also have at least one turntable assembly positioned on one of the plurality of panels that is rotatable about a generally vertically oriented axis relative to the panel. Each rear socket can also be adapted to absorb forces applied thereat by permitting relative movement between a riser received therein and the respective panel.

31 Claims, 11 Drawing Sheets

U.S. PATENT DOCUMENTS 5,881,653 A * 3/1999 Pfister ..... 108/147.13
D409,868 S 5/1999 France ..... D6/562
6,015,053 A * 1/2000 Sheng ..... 211/188
6,016,927 A 1/2000 Krupp ..... 211/126.2
6,059,128 A * 5/2000 Wang ..... 211/90.01
6,079,339 A 6/2000 Houk, Jr. et al. ..... 108/186
6,178,896 B1 1/2001 Houk, Jr. et al. ..... 108/186
6,182,839 B1 2/2001 Robbins et al. ..... 211/78
D444,017 S * 6/2001 Walker ..... D6/562
6,520,356 B2 * 2/2003 Miller, Jr. ..... 211/188

* cited by examiner

MULTI-TIERED CORNER SHELVING UNIT

RELATED APPLICATION DATA

This patent is related to co-pending U.S. provisional application Ser. No. 60/355,515, which was filed on Feb. 7, 2002.

BACKGROUND OF THE DISCLOSURE

1. Field of the Disclosure

The present invention relates generally to shelving systems, and more particularly to a modular shelving unit for mounting in a corner.

2. Description of the Related Art

It is known in the art to provide modular shelving systems or units. One type of modular unit includes a plurality of rectangular panels or shelves, wherein each shelf has four sockets, one provided in each corner of the shelf. Successive shelves can be stacked and interconnected to vertically adjacent shelves by inserting posts or risers into each of the sockets. The modular construction provides flexibility for the consumer to assemble a shelf system or unit with a desired number of shelves and/or a desired height. Examples of such shelving systems are disclosed in, for example, U.S. Pat. Nos. 6,079,339 and 6,178,896, each incorporated herein by reference in their entirety. Each shelf of the units disclosed in these exemplary patents typically provides a planar storage surface for supporting stored objects.

One problem with these known modular shelving units is that if you stack a large amount of material on the units, it can be difficult to access stored objects hidden behind other stored objects on each shelf. It can be time consuming and quite a nuisance to have to move a number of objects in order to access a hidden object on a shelf. It can also be uncomfortable to do so on lower shelves, as the user will likely have to bend or kneel to access the shelf while looking for a particular object.

Another problem with these known shelving units is that they are typically of a rectangular shelf or panel construction wherein each shelf has a greater width than a depth. Such units can be mounted against a wall and can have one end placed in and abutting a corner of the room. A shelf unit can be mounted adjacent either wall at a corner. The shelf unit sticks out into the room environment at the end opposite the corner facing end and can impede foot traffic within the room space. If such a unit were mounted in a corner at an angle traversing the walls at the corner, the unit would extend quite a ways into the room, also impeding traffic around the unit. Further, since the shelves are typically rectangular, the space behind each shelf when the unit is placed in a corner is not suitable for storing objects because the shelves do not extend all the way to the corner, rending the corner space unusable.

Moreover, shelving units supported by socket and riser assemblies, such as those disclosed in the above-noted patents, often transmit a disproportionate amount of force to one particular socket and supporting riser of each shelf or panel. This is caused, in part, by the rigid connection between the socket and riser, and in part by the rigid structure of the socket. The entire force at each riser, and particularly at the heavily loaded riser, the riser of the shelf applied to the socket is directly distributed into the panel and the riser. Such force distribution to rigid components can cause either or both the panel around the socket and the riser to crack or fail. If this occurs even at one connection, the entire shelving structure is weakened.

BRIEF DESCRIPTION OF THE DRAWINGS

Objects, features, and advantages of the present invention will become apparent upon reading the following description in conjunction with the drawing figures, in which.

DETAILED DESCRIPTION OF THE PREFERRED EMBODIMENTS

Figure 1:
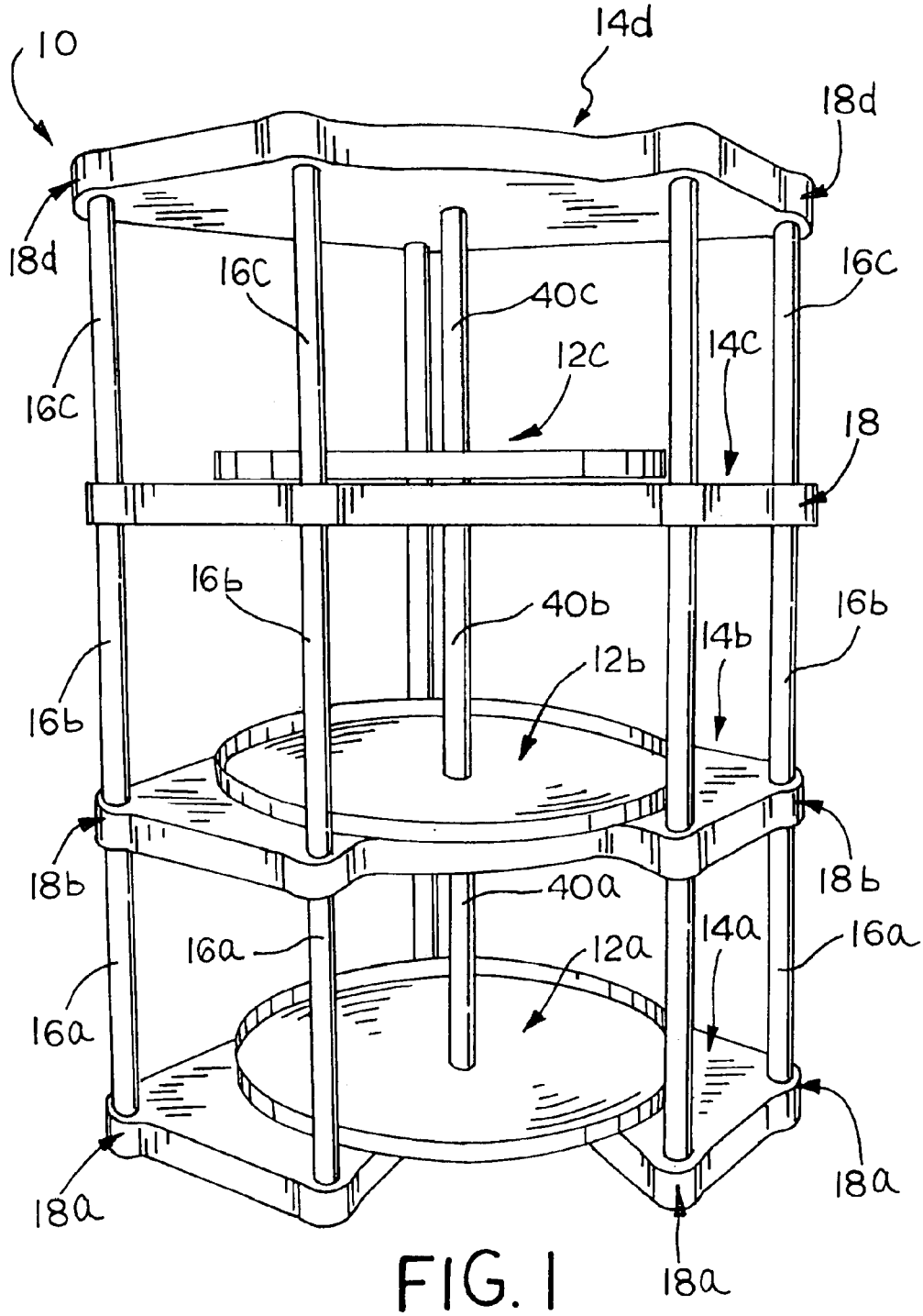
FIG. 1 is a front view of one example of a multi-tiered shelving unit constructed in accordance with the teachings of the present invention.

The disclosed shelving units are each directed to a modular shelving unit 10 that either solves or improves upon one or more of the problems in the prior art described above. Particularly, multi-tiered modular shelving units are disclosed herein. One of the disclosed modular shelving units is configured to mount in a corner of a room and incorporates one or more turntable assemblies 12 or "lazy-suzan" structures that are modular and simple in construction. A turntable assembly can be selectively installed or not installed on each given shelf of the unit as desired without otherwise affecting the unit structure. Another exemplary shelving unit described herein includes no turntable assemblies but is configured to mount in a corner of a room and is adapted to provide storage space on each shelf completely into the corner of the room. Yet another exemplary shelving unit has a weakened socket and riser assembly for deflecting force away from the risers. Each of the entire shelving units disclosed herein, both with or without one or more turntables, can be easily broken down and assembled without the use of tools and in a very simple manner.

Referring now to the drawings, one of the modular shelving units disclosed herein is illustrated in FIGS. 1–5 and is identified as the modular shelf unit 10. The unit 10 has a plurality of panels 14 that define support surfaces or regions for storing objects, as do prior known modular units. These panels 14 are interconnected, stacked, and vertically spaced by a plurality of elongate risers 16. Each pair of adjacent panels 14 is separated and interconnected by inserting each riser 16 into a corresponding socket 18 formed in the facing sides of the panels. The connection between the socket and riser forms a socket junction. Each socket 18 of each panel 14 of the modular unit 10 can be adapted to receive a riser 16 inserted from either or both the underside of the panel and the top side of the panel. Thus, this construction permits modular assembly and stacking of multiple panels as desired, and yet also permits manufacture and assembly of multiple identical panels and risers to comprise a modular unit. Alternatively, a given unit can be provided with two or more different panel structures if desired for a particular application.

As used herein, the term "panel" describes any of a plurality of possible structures suitable for supporting and storing objects thereby constituting one shelf, a plurality of which define a shelving system. Various alternatives or modifications for the panels can be substituted and yet fall within the scope and spirit of the present invention.

Generally, the risers 16 and panels 14 can be fabricated from relatively light weight, durable, and sturdy plastic or thermoplastic materials such as polyethylene, polypropylene, polystyrene, or other suitable plastic materials. The process or processes used to form the various components of the disclosed shelf unit 10 can also vary considerably as necessary to form each given component. For example, the risers 16 can be elongate hollow plastic tubes. The risers can be injection molded, blow molded, extruded, vacuum formed, rotation molded, or the like. The manufacturing process or processes can be selected based on feasibility, cost, tooling concerns, as well as other factors for a given application.

Either one or both end section 20 (top end as installed) and 22 (bottom end as installed) of the risers 16 can be designed and adapted with specific structural features and characteristics such as a taper 24 (shown only on bottom end sections 22 herein) that mate with corresponding features and characteristics of the sockets 11. Similarly, either the top side, the bottom side, or both sides of the sockets 18 can be constructed as desired. Alternatively, one or both ends 20, 22 of each riser 16 can simply be a circular cylinder of the same or a reduced diameter relative to the diameter of the riser exterior surface. The sockets 18 can be further adapted or constructed in a corresponding manner to accept this simple cylindrical riser.

The panel construction can also vary considerably. For example, the panels 14 can be fabricated from plastic materials such as polypropylene, polyethylene, polystyrene, or other suitable plastic materials. The panels can have solid, non-perforated storage surfaces, structural ribs added for panel rigidity, open mesh or grid storage surfaces, or other such features, depending on the needs of a given application. One or more of the panels can have a generally planar top or storage surface, can include surface variations and features for storing particular objects, can be in the form of a shallow depth basket, or the like. The panels can also be molded or otherwise formed utilizing a suitable molding or other process.

The modular construction of the storage unit 10 disclosed herein renders the unit easy to assemble and break down. When broken down, the unit 10 can be easily and compactly packaged in a carton for shipping and transport. No tools are required to assemble or break down the unit.

Each example of a modular shelf or storage unit 10 shown or described herein can be assembled utilizing one or more of the so-called panels 14 and any number of the risers 16 as necessary to support each panel. Particular features and characteristics of the modular unit 10 are now described with reference to accompanying drawing figures.

FIGS. 1–5 illustrate one example of the multi-tiered shelving or storage unit 10 constructed in accordance with the teachings of the present invention. The plurality of object supporting panels 14 are provided in the form of generally planar shelves in this example. Each shelf 14 has an upper storage surface 26 for storing objects (not shown) thereon. Because the unit 10 is modular, one or more of the shelves 14 could be replaced, if desired, with an alternate panel or object supporting structure. However, the alternate structure or structures must cooperatively adapt to the configuration of the remaining components of the unit 10. In this disclosed example, the shelves 14 are essentially identical and interchangeable with one another.

Each disclosed shelf 14 is generally crescent shaped in plan view and adapted for placement in a corner of a room. However, as will be evident to those having ordinary skill in the art, the shelves 14 in the example illustrated in FIGS. 1–5 can have virtually any polygonal, rounded, or other shape, such as circular, triangular, rectangular, or the like. The shape of the shelves 14 or other such panels can vary considerably according to the needs of a particular application.

Each shelf 14 disclosed herein has a pair of back edges 30 arranged generally perpendicular to one another. Respective ends of the back edges 30 meet at and define a rear shelf corner 32 which can be positioned in a corner of a room. Alternatively, a corner apex may join the back edges such that there is a space between the rear shelf corner and the corner of the room. This corner apex may be circular or have one or more edges. An opposite end of each back edge 30 terminates and connects with a corresponding rear end of a respective side edge 34. The side edges 34 in this example are oriented perpendicular relative to the back edges 30 and to one another, though their orientation can vary considerably. The back and side edges in this example are also linear, though the shape of the respective edges can vary without departing from the spirit and scope of the present invention.

Each forward end of the side edges 34 joins with a respective opposed end of a front face 36 of the shelf. Again, the front face 36 of each shelf 14 can be linear or can be some other shape, though the disclosed front face is a segmented, angled configuration.

A socket 18 is positioned at each shelf corner where adjacent edges or faces of the shelf meet. Each socket 18 is open at both a top side of the panel and a bottom side of the panel, thus defining a top receptacle and a bottom receptacle for receiving therein an end section 20 or 22 of a riser 16.

Each shelf also has a "land locked" or interior socket 38 that is located generally centrally within the shelf in this example. The interior socket 38 can be essentially identical to the sockets 18, and is preferably so in this example. The interior socket 38 also is adapted to receive an interior riser 40 from both a top side and a bottom side of each shelf. The interior riser 40 can be essentially identical to the other riser 16, and is preferably so in this example. A turntable assembly 12 can be installed, if desired, on the interior riser 40, as described below in greater detail.

The plurality of risers 16 for the disclosed unit 10 interconnect the plurality of shelves 14 in a spaced apart and stacked configuration as shown in the drawings. The plurality of shelves 14 are identified hereinafter as shelves 14*a*, 14*b*, 14*c*, and 14*d*, moving from the bottom to the top in FIG. 1. The turntable assemblies, sockets, and risers associated with each shelf are similarly identified hereinafter for convenience of description. In the disclosed example, the bottom shelf 14*a* rests on a ground or floor surface. In this example, the bottom end sections 22*a* of the risers 16*a* are installed into the top side of each socket 18*a* and 38*a* of the shelf 14*a*. If desired, a turntable assembly 12*a* can be installed on the interior riser 40*a*.

The next upwardly adjacent shelf 14*b* is then installed on the previously installed risers 16*a* and 40*a*. The upper ends 20*a* of the installed risers 16*a* and 40*a* are received in the bottom side of sockets 18*a* and 38*a*. A next set of risers 16*b* and 40*b* can then be installed in the sockets 18*b* and 38*b* of the shelf 14*b*. Again, a turntable assembly 12*b* can be installed on the interior riser 40*b*, if desired. The next adjacent shelf 14*c* is similarly installed on the risers 16*b* and 40*b*. Risers 16*c* and 40*c* are then installed in the sockets 18*c* and 38*c*. A turntable 12*c* can optionally be installed as before. The last or upper most shelf 14*d* is installed on the risers 16*c* and 40*c*. If another shelf were to be installed, another set of risers (not shown) would the be installed as before into the top side of the sockets 18*d* and 38*d*. Here, the unit only utilizes four shelves and, therefore, a maximum of three sets of risers and turntable assemblies need be used. One or more additional shelves can be added or removed to increase or decrease the storage space and height of the unit.

Figure 2:
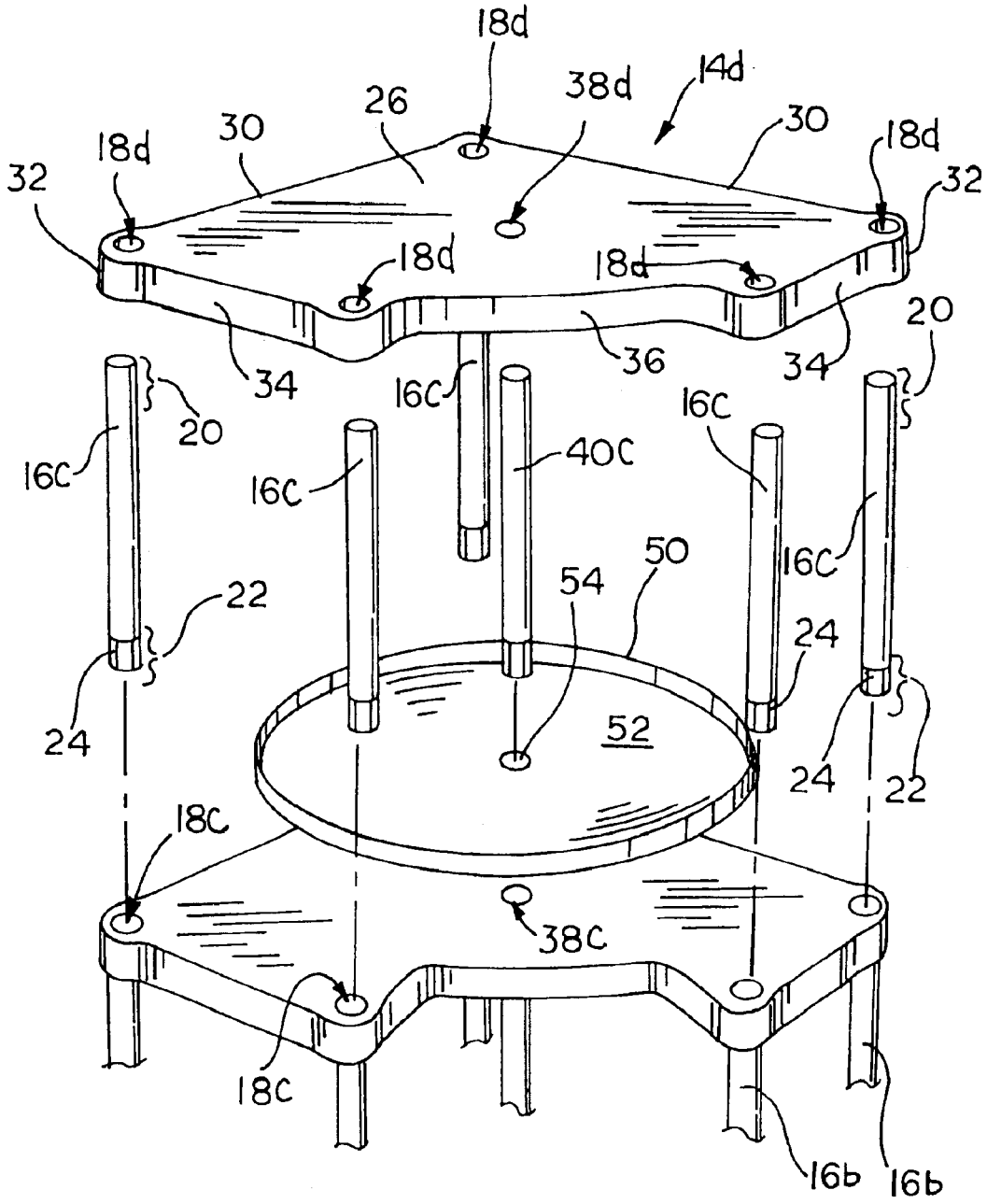
FIG. 2 is a partially exploded view of the shelving unit shown in FIG. 1.
Figure 3:
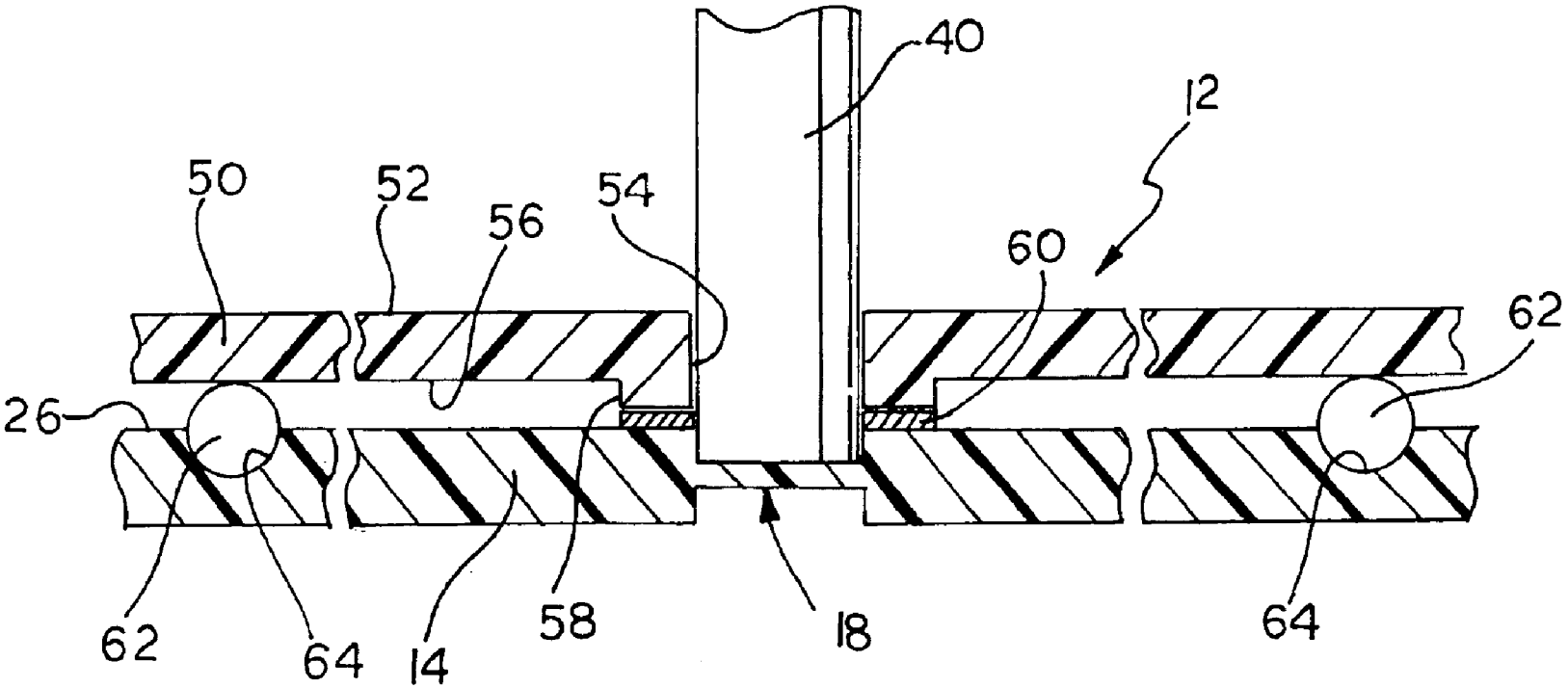
FIG. 3 is a cross section of a turntable assembly as shown in FIG. 1.
Figure 4:
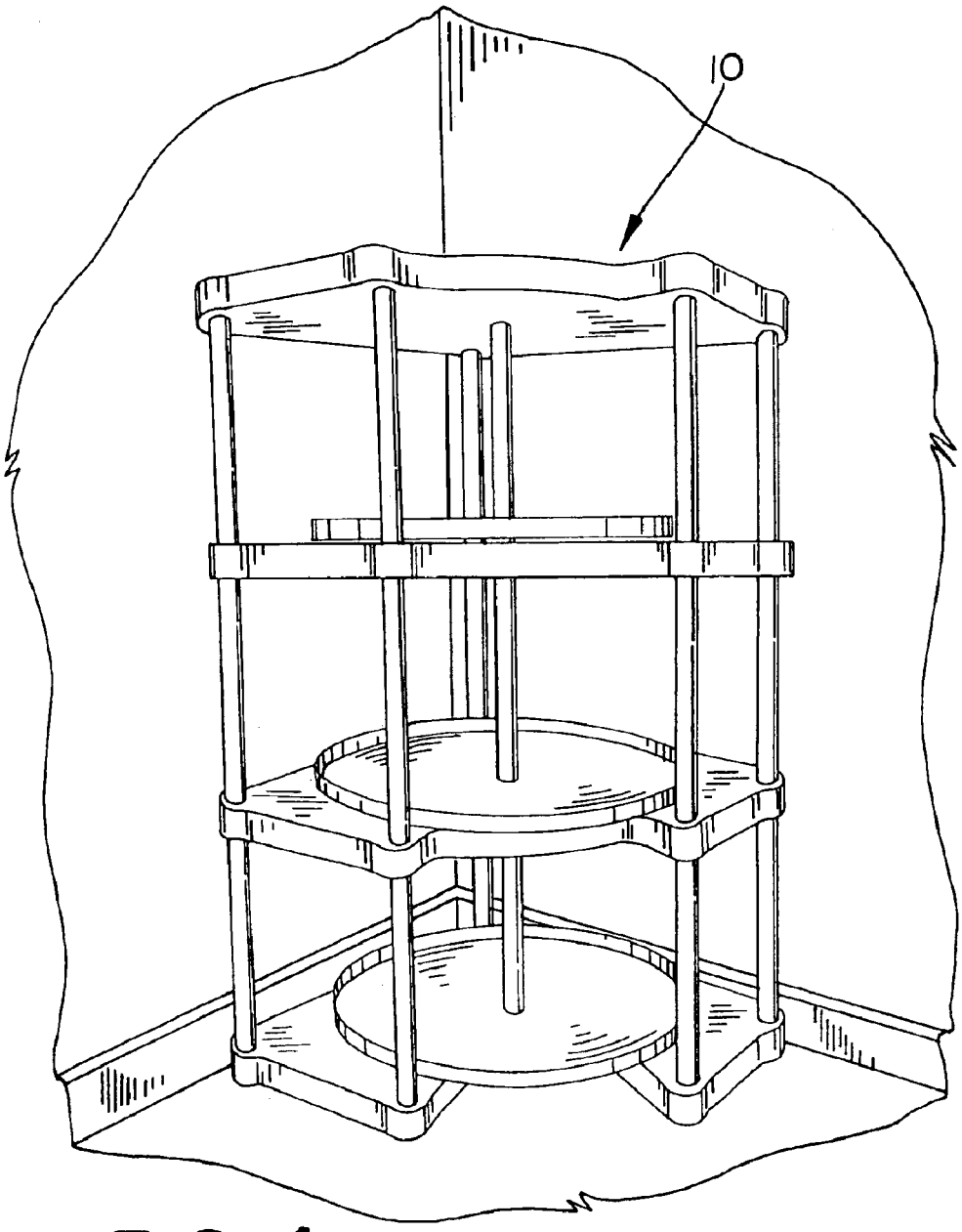
FIG. 4 depicts a front view of a multi-tiered shelving unit such as that shown in FIG. 1 and positioned in a corner.
Figure 5:
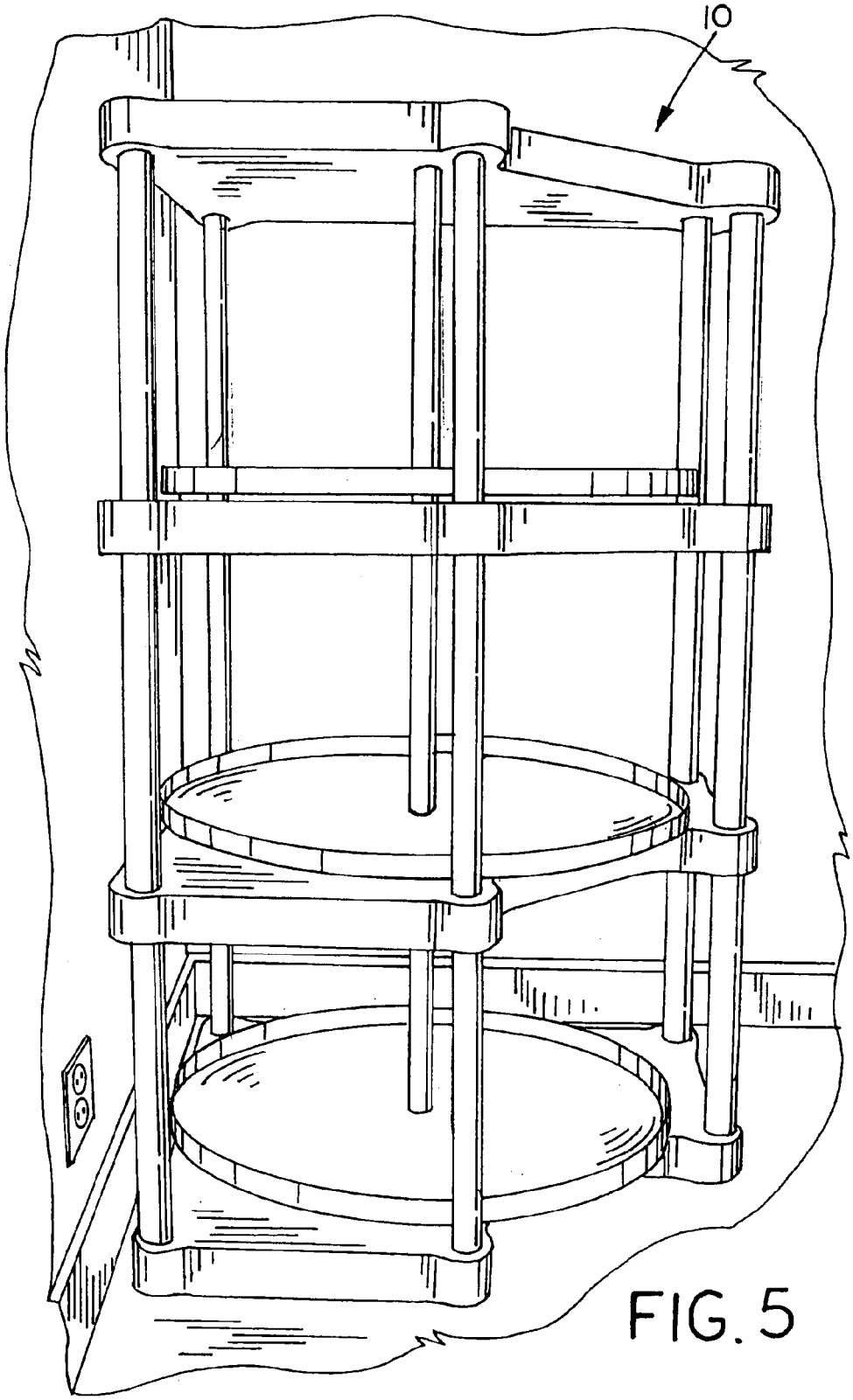
FIG. 5 depicts a side view of the shelving unit shown in FIG. 4.

Referring particularly to FIGS. 2 and 3, each turntable assembly 12 can include, in this example, a turntable 50 having a top storage surface 52, a center opening 54, and a bottom surface 56. The center opening 54 of the turntable 50 is mounted or installed over a selected one of the interior risers 40. The turntable 50 can be molded or otherwise formed from a suitable material such as polypropylene, polyethylene, polystyrene, or the like.

A raised bushing or bearing surface 58 of the turntable 50 surrounds the center opening 54 and extends downward from the bottom surface 56 of the turntable and radially outward from the center opening. A washer 60 is installed between the bearing surface 58 and the top surface 26 of the shelf 14. The washer 60 can be made from any suitable material for reducing static and sliding friction, such as, for example, TEFLON. However, the material should at least be compatible with the shelf and turntable materials and be wear resistant. The washer material also preferably results in reduced sliding friction for the rotating turntable 50. The raised bearing surface 58 is preferably of a height such that the bottom surface 56 of the turntable 50 is elevated slightly above the top surface 26 of the shelf 14.

A plurality of roller-type or ball-type bearings 62 can be provided between the bottom surface 56 and the top surface 26 of the shelf 14. The bearings 62 further support the turntable 14 and enhance the rotational capability of the turntable. Thus, the turntable can support unevenly distributed object loads on its storage surface 52 and can rotate easily even when heavily loaded with objects. The bearings 62 can again be made from any suitable material such as wear resistant thermoplastic, and in one example are TEFLON bearings. In this disclosed example, the shelves 14 and turntables 50 are preferably made from a highly durable material such as a heavy polyethylene or a polystyrene. The shelf and turntable materials can be selected to prevent premature wear caused by rolling and/or sliding movement between the bearings 62 and both the shelf and the turntable materials during use.

In this example, the bearings 62 are mounted in bearing depressions 64 formed in the top surface 26 of each shelf 14. The depressions 64 can alternatively be provided in the bottom surface of the turntable. Alternatively, a recessed track (not shown) can be provided in either the shelf top surface or the turntable bottom surface. The bearings can then be retained in the track and roll freely therein. In any alternative, the bearings 62 are preferably arranged in a circumferential path concentric with the turntable so that they support the turntable at a consistent location as the turntable rotates. In one example, the bearings 62 are positioned about two thirds the radial distance outward from the axis of the turntable center opening 54. The bearings 62 are preferably spaced apart circumferentially relative to the circumference of the track turntable 50. In one example, the depressions 64 and bearings 62 can be spaced apart circumferentially at desired intervals, depending upon the size of the turntable 50. The structure used to retain the bearings 62 can be virtually any construction suitable to retain the bearings at the desired spacing.

An installed turntable assembly 12 can be rotated about its respective interior riser 40 to access any part of the storage surface 52. The bearings 62 and washer 60 assist in making rotation of the turntable relatively easy, even when loaded with stored objects. Preferably, the front surface 36 of each shelf 14 is design to permit a result in a slight overhang of a turntable 50 beyond a front surface edge of the shelf. In this manner, a consumer can easily grasp the exposed front part of the turntable to impart rotation to the turntable assembly 12.

If a consumer prefers not to install a turntable assembly 12 on one or more of the shelves 14, the appropriate interior riser 40 can be installed without installing the turntable 50. If the bearings are mounted to the shelf 14, they can be removed to provide a smooth object storage surface. If the bearings are mounted to the bottom surface of the turntable 50, nothing else need be done.

Figure 6:
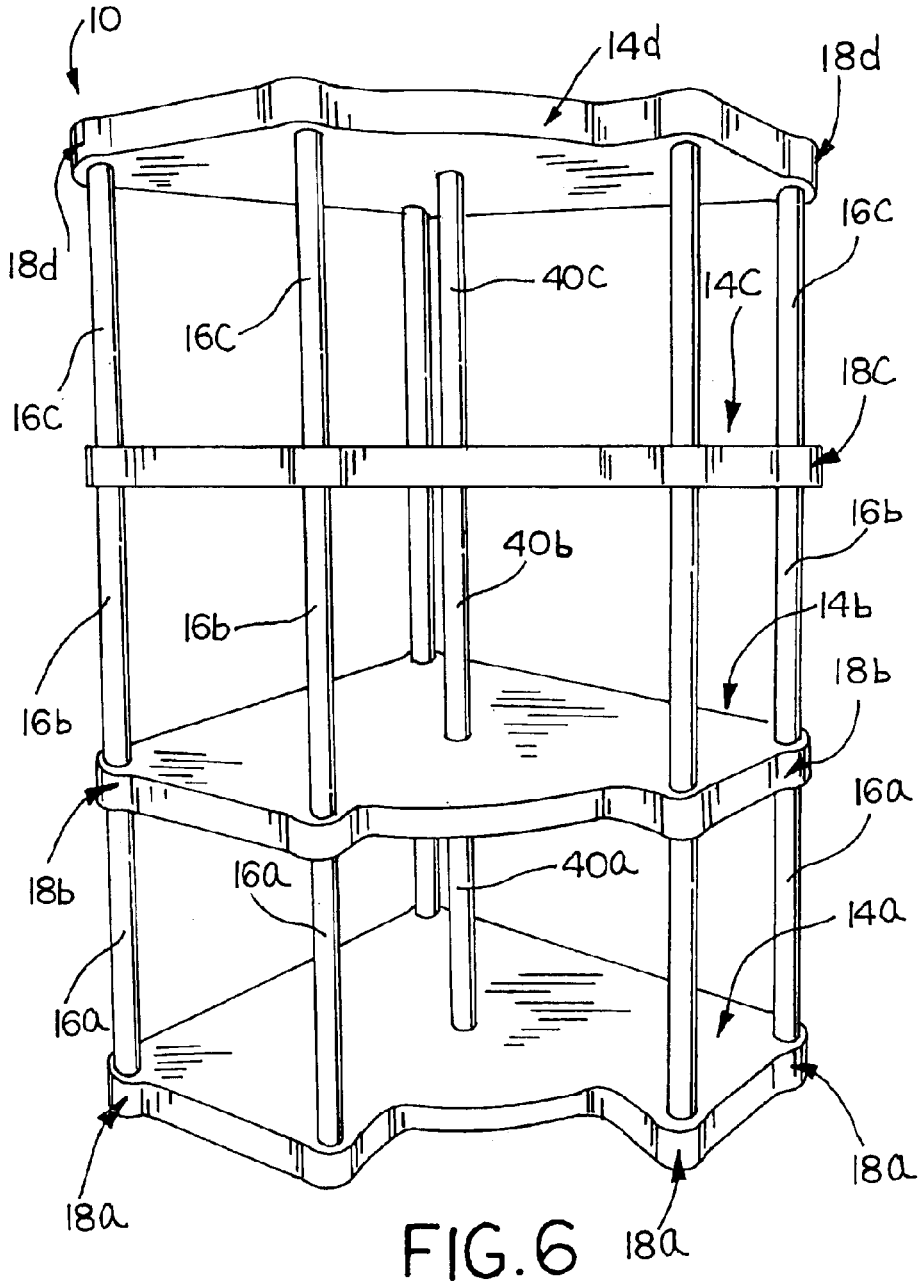
FIG. 6 is a front view of another example of a multi-tiered shelving unit constructed in accordance with the teachings of the present invention.
Figure 7:
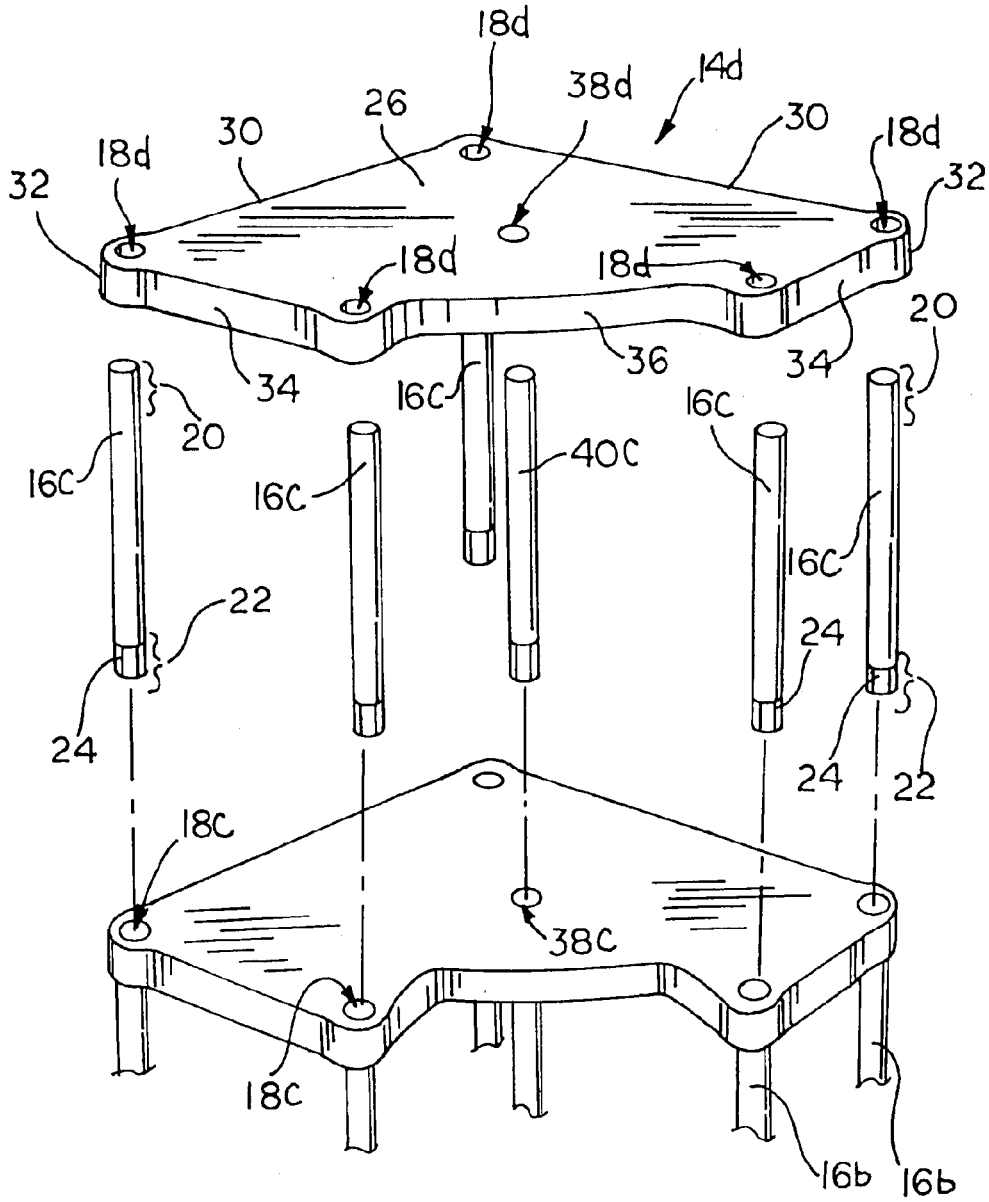
FIG. 7 is a partially exploded view of the shelving unit shown in FIG. 6.

FIGS. 6 and 7 illustrate another example of a multi-tiered shelving unit 100 constructed in accordance with the present invention. In this example, the unit 100 is essentially the same as the unit 10 described above and is shown utilizing the same reference characters for identifying the carious shelves 14, riser 16, 40, and sockets 18, 38. However, the unit 100 does not have any turntable assemblies 12. Instead, the unit 100 is simply a corner mounted shelving unit.

To achieve such a unit, a consumer can assemble the unit 10 and exclude all of turntables, thus resulting in a corner storage multi-tiered shelving unit nearly the same as the unit 100. The user can also exclude the interior risers 40 if desired and if structurally feasible. Alternatively, a unit 100 can be designed and built for use without turntable assemblies 12. Such a unit 100 could then eliminate the interior risers 40, the interior sockets 38, and the panel features such as the depressions 64, bearings 62, and washer 60. However, the riser 40 and sockets 38 can be provided as additional support for the panels 14 even though turntables are to be utilized.

Figure 8:
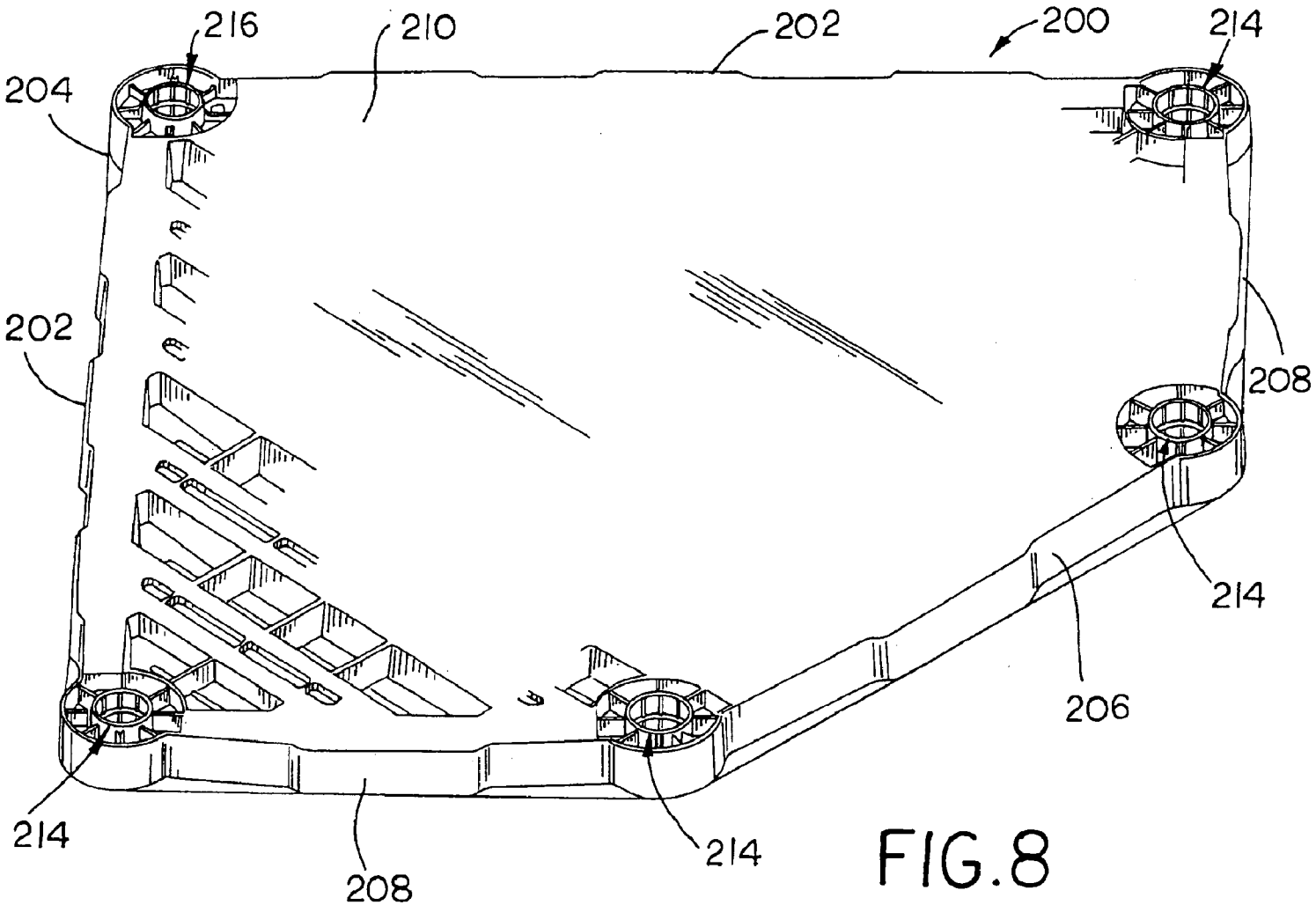
FIG. 8 is a perspective view of one example of a panel for the shelving units shown in FIGS. 1 and 6, and including an example of a socket constructed in accordance with the teachings of the present invention.
Figure 9:
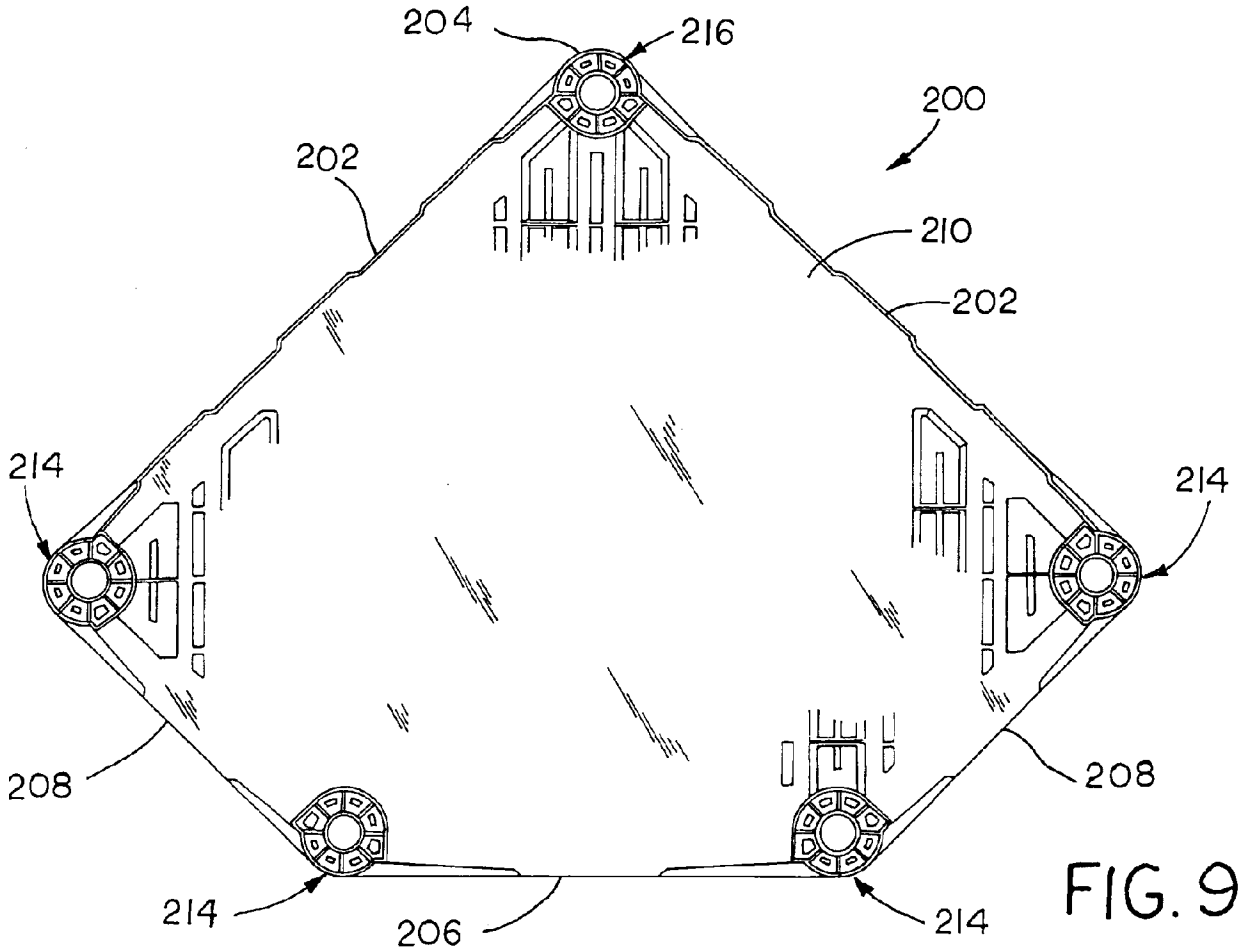
FIG. 9 is a top plan view of the panel shown in FIG. 8.
Figure 10:
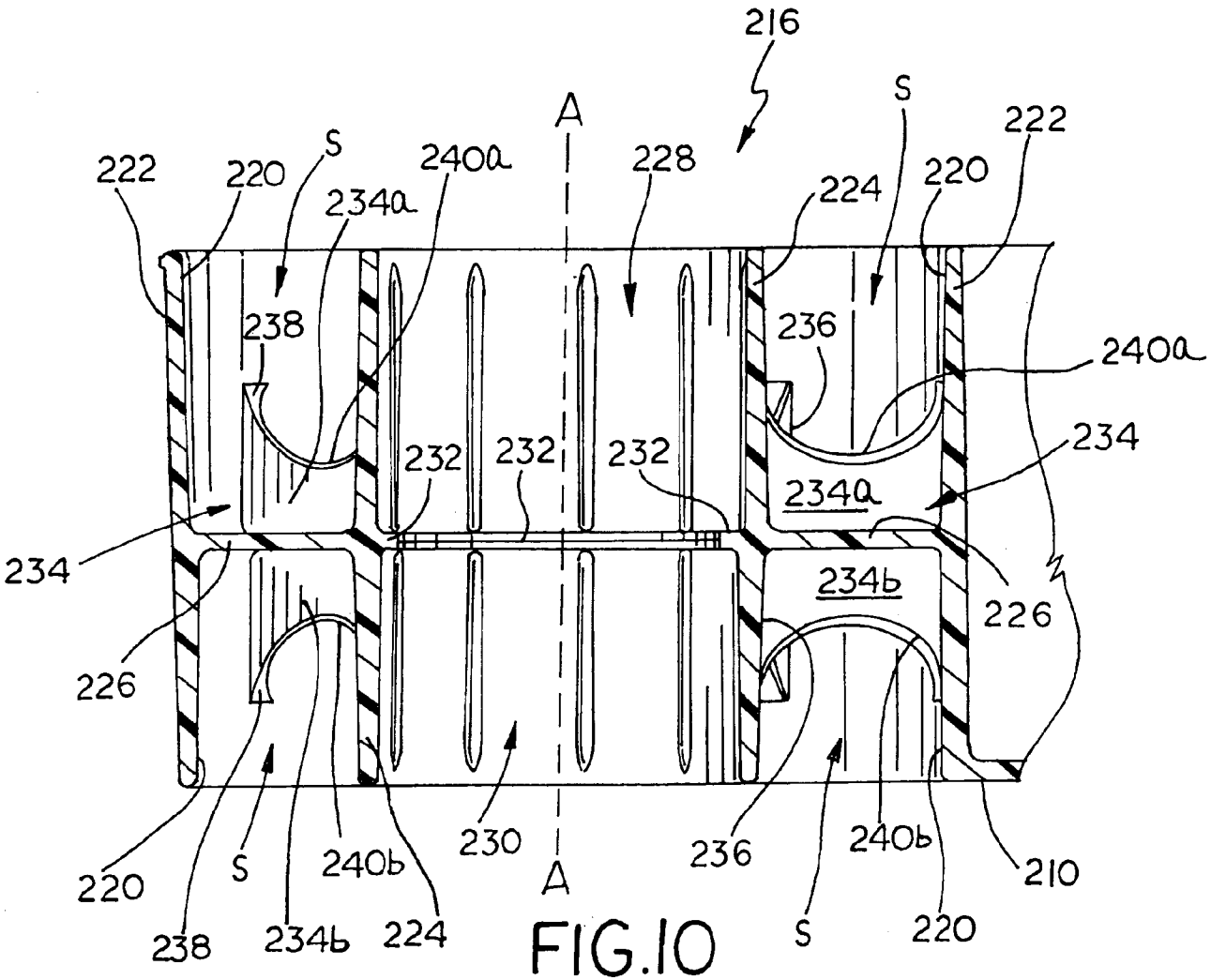
FIG. 10 is a side cross-section of the rear socket taken along line X—X of the panel in FIG. 9.

FIGS. 8, 9, and 10 illustrate another example of a panel 200 a for multi-tiered shelving unit constructed in accordance with the present invention. In this example, the panel 200 has a different shape than that illustrated in the prior examples. The disclosed panel 200 has a five sided or heptagonal shaped perimeter. The panel 200 has five side edges including a pair of back edges 202 that meet and define a back corner 204. The panel 200 also has a three segment forward edge including a front edge 206 and a pair of intermediate edges 208. The panel 200 also has an upper surface 210, an underside 212, and a plurality of sockets 214 which include a rear socket 216 near the back corner 204. As will be evident to those having ordinary skill in the art, and as mentioned above, the shape of the corner shelving unit panels can vary and yet fall within the scope and spirit of the present disclosure.

The panel 200 can include a means for reducing stress at the rear socket 216, although any one or all of the sockets 214 and 216 can alternatively or also include this feature as desired. In this example, the rear socket 216 includes an opening 220 through the panel extending between the upper surface 210 and the underside 212. The opening 220 is defined by a cylindrical continuous wall 222 formed as part of the panel. In this example, the opening 220 is generally vertically oriented relative to a horizontal panel orientation, and the wall 222 is also generally vertically oriented. However, the wall 222 and opening 220 can vary from the generally vertical orientations shown. For example, the wall 222 can be inclined or declined relative to a vertical opening axis "A", or an upper part of the wall 222 can be inclined and a lower part of the wall can be declined relative to the opening axis. Also, the wall 222 in this example forms a circular cylindrical opening 220, though other cylindrical shapes can also be utilized.

The socket 216 in this example also has a cylindrical tube 224 positioned within the opening 220 and spaced from the wall 222, thus forming a space "S" therebetween. The tube is correspondingly shaped relative to the opening, and thus, in this example is a circular cylinder. A generally horizontally arranged support 226 extends around the opening 220 between the wall 222 and the tube 224. The support 226 supports the tube suspended in the opening. The support in this example is integrally molded or formed as part of the panel and wall material. In this example, the support 226 is positioned about midway between the upper side 210 and the underside 212 of the panel 200, but slightly nearer the underside. The support 226 can be positioned exactly midway along the tube if desired. The support 226 suspends the tube 224 within the opening 220 and yet will permit the tube to move based on flexure of the support and loads applied via a riser or risers inserted into the tube.

The tube 224 defines a top receptacle 228 and a bottom receptacle 230 of the socket 216. In this example, the top receptacle 228 is slightly larger in diameter and is slightly longer or deeper that the bottom receptacle 230. A divider ridge 232 is provided within the tube 224 to provide a positive stop surface for a riser inserted into either receptacle. In this example, the receptacles 228 and 230 are sized differently to accommodate a riser having two different ends, as mentioned above. However, the receptacles 228 and 230 can be substantially identical in all respects in order to accept either end of a symmetrical riser, if desired.

The socket 216 also has a plurality of rib buttresses 234 that are oriented generally vertically in this example. Again, the rib buttresses 234 can be oriented at an angle relative to vertical, if desired. In this example, each rib buttress has an upper section 234*a* positioned above the support 226 and a lower section 234*b* positioned below the support 226. Each buttress 234 also has an inner portion 236 connected to the tube 224 and an outer portion 238 connected to the wall 222. The buttresses, depending upon height, material selection, and thickness, assist in suspending and supporting the tube 224 within the opening 220. The buttresses 234, if formed having a height as tall as a wall height of the wall 222, result in a substantially rigid socket structure. It has been learned that a rigid connection at the rear socket and riser will cause either the panel, socket, and/or the riser to break under stress.

Thus, as shown in FIGS. 8 and 10, each buttress rib 234 has a scalloped portion. In this example, a scalloped portion with a cut out 240*a* is provided on the upper section 234*a* and a scalloped portion with a cut out 240*b* is provided on the lower section 234*b*. It is possible to provide a cut out only the top edges or the bottom edges, or to provide a top cutout and a bottom cut out on only some of the ribs 234 or on alternating ribs, as needed for a particular application. The scalloped buttress ribs 234 provide structural stability to the sockets 216, and yet permit some flexibility between the tube 224 and the opening 220. The flexibility permits some relative movement between the socket tube 224 and the panel 200, which relieves significant stress at the socket and riser joint. The cut outs 240 in this example are smooth curves similar to an arc of a circle. However, the cut out shapes and sizes can vary considerably without departing from the spirit and scope of the disclosure, and can vary from rib to rib.

The buttress ribs 234 and support 226 may be molded or otherwise formed from a suitable material such as polypropylene, polyethylene, polystyrene, or the like. Alternatively, the support and the ribs may be formed from any other suitable material that permits slight bending or deflection while maintaining the overall strength and stability of the shelving unit. The socket 216 including the support 226, opening 220, tube 224, and ribs 234 can thus be formed from the same material as the panel 200, and can be formed integrally therewith. Alternatively, the socket 216 can be formed as a separate component from a suitable material, and then can be inserted into the panel or insert molded as part of the panel.

As a load is applied to the panel, stress is transmitted to the socket and dissipated into the support, ribs, and tube as it moves relative to the panel. Thus, stress is relieved from the panel itself and is dissipated prior to being transmitted into the riser. Additional relief openings 244 can be provided in the support 226 between the buttress ribs 234, the tube 224 and the wall 220. The relief openings can further assist in adding flexibility to the socket structure.

Figure 11:
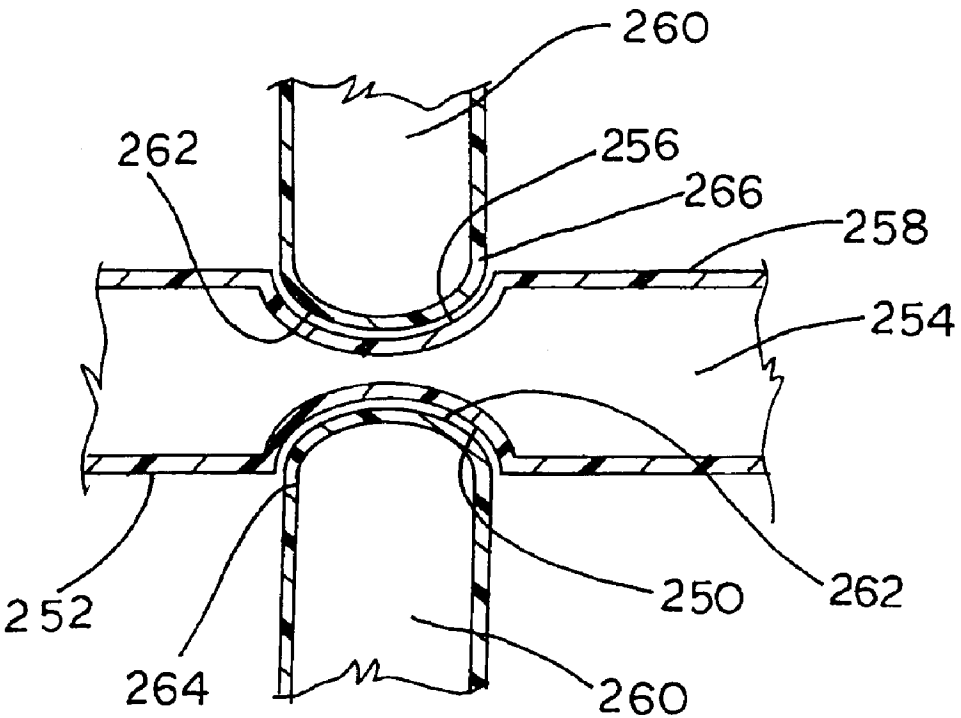
FIG. 11 illustrates a cross section of another example of a socket and riser connection constructed in accordance with the teachings of the present invention.

FIG. 11 illustrates an alternative stress reducing means for the sockets 214 and 216, and particularly for the rear socket 216 as in this example. A semi-spherical shaped depression 250 is formed or provided in the underside 252 of a panel 254. A similarly or identically shaped depression 256 is formed or provided in an upper side 258 of the panel 254. Each rear riser 260 in this example has a ball 262 or dome shaped surface on both the upper end 264 and the lower end 266. The ball of the appropriate end 264 or 266 of a riser is simply placed in each appropriate socket or depression 250 or 256. If the many or all of the remaining risers and sockets of the system, other than the rear sockets and risers, provide a substantially fixed connection, this ball and socket type joint will relieve a substantial amount of stress from the panel, socket and riser. The ends of the riser can move freely relative to the depression, and thus the panel.

The depressions or sockets 250 and 256 can be formed integral with the panel surfaces, or can be formed separately and added to the panel using any suitable process. Additionally, the domed surfaces or balls 262 can also be formed integrally with the risers 260, or can be formed separately and added thereto in any suitable manner.

Although certain modular shelving units have been disclosed and described herein in accordance with the teachings of the present invention, the scope of coverage of this patent is not limited thereto. On the contrary, this patent covers all embodiments of the teachings of the invention fairly falling within the scope of the invention, either literally or under the doctrine of equivalents.

What is claimed is:

1. A corner shelving system comprising:

a plurality of panels arranged vertically stacked and spaced apart, each panel having an upper surface, an underside, a perimeter including a pair of back edges, a back corner and at least one front edge, and having a plurality of sockets, one of which is a rear socket positioned near the back corner, and wherein each socket defines a top receptacle accessible from the upper surface and a bottom receptacle accessible from the underside of the panel;

a plurality of elongate risers each having a lower end received in a toy receptacle of a socket of one panel and an upper end received in a bottom receptacle of a corresponding socket of an adjacently upward panel; and at least one turntable assembly removably supported on the upper surface of one panel of the plurality of panels and rotatable about a generally vertically oriented axis, the at least one turntable having a toy storage surface, wherein each of the plurality of panels defines a heptagonal upper surface.

2. The shelving system of claim 1, wherein each rear socket is adapted to absorb forces applied thereat by permitting relative movement between a riser received therein and the respective panel.

3. The shelving system of claim 1, wherein the risers are fabricated from a material selected from polyethylene, polypropylene, and polystyrene.

4. The shelving system of claim 1, wherein the upper surface of each of the plurality of panels is non-perforated.

5. The shelving system of claim 1, wherein each of the plurality of panels has structural ribs.

6. The shelving system of claim 1, wherein the upper surface of each of the plurality of panels forms an open grid pattern.

7. A corner shelving system comprising:

a plurality of panels arranged vertically stacked and spaced apart, each panel having an upper surface, an underside, a perimeter including a pair of back edges, a back corner and at least one front edge, and having a plurality of sockets, one of which is a rear socket positioned near the back corner, and wherein each socket defines a top receptacle accessible from the upper surface and a bottom receptacle accessible from the underside of the panel;

a plurality of elongate risers each having a lower end received in a top receptacle of a socket of one panel and an upper end received in a bottom receptacle of a corresponding socket of an adjacently upward panel;

at least one turntable assembly removably supported on the upper surface of one panel of the plurality of panels and rotatable about a generally vertically oriented axis, the at least one turntable having a top storage surface;

an interior socket positioned interior to the perimeter of each of the plurality of panels, each interior socket having a top receptacle accessible from the upper surface and a bottom receptacle accessible from the underside of the respective panel; and an interior riser having a lower end received in the top receptacle of an interior socket of the one panel and an upper end received in the bottom receptacle of a corresponding interior socket of an adjacently upward panel, wherein the at least one turntable assembly is mounted for rotation about the interior riser.

8. The shelving system of claim 7, wherein the pair of back edges of each panel are generally perpendicular to one another.

9. The shelving system of claim 7, wherein the upper and lower ends of the risers are circular cylinders.

10. The shelving system of claim 7, wherein the top and bottom receptacles of the plurality of sockets are circular cylinders.

11. The shelving system of claim 7, wherein each of the plurality of panels is essentially identically shaped.

12. The shelving system of claim 7, wherein each of the plurality of panels defines a substantially triangular upper surface.

13. The shelving system of claim 7, wherein each of the plurality of panels defines an upper surface in the shape of a quarter segment of a circle.

14. The shelving system of claim 7, wherein the risers are fabricated from a material selected from polyethylene, polypropylene, and polystyrene.

15. The shelving system of claim 7, wherein the upper surface of each of the plurality of panels is non-perforated.

16. The shelving system of claim 7, wherein each of the plurality of panels has structural ribs.

17. The shelving system of claim 7, wherein the upper surface of each of the plurality of panels forms an open grid pattern.

18. The shelving system of claim 7, further comprising:

two or more of the turntable assemblies, each of the two or more turntable assemblies disposed on a separate one of the plurality of panels.

19. The shelving system of claim 7, wherein the at least one turntable assembly is positioned between the one panel and an adjacently upward panel.

20. The shelving system of claim 7, wherein the at least one turntable assembly is mounted for rotation about the interior riser.

21. The shelving system of claim 7, wherein the at least one turntable assembly is a circular panel and has a center opening through which the interior riser passes.

22. The shelving system of claim 21, further comprising:

a bearing surface provided on a bottom surface of the at least one turntable assembly and surrounding the center opening; and a washer positioned between the upper surface of the one panel and the bearing surface whereby the bearing surface rests on the washer.

23. The shelving system of claim 7, wherein each rear socket is adapted to absorb forces applied thereat by permitting relative movement between a riser received therein and the respective panel.

24. A corner shelving system comprising:

a plurality of panels arranged vertically stacked and spaced apart, each panel having an upper surface, an underside, a perimeter including a pair of back edges, a back corner and at least one front edge, and having a plurality of sockets, one of which is a rear socket positioned near the back corner, and wherein each socket defines a top receptacle accessible from the upper surface and a bottom receptacle accessible from the underside of the panel;

a plurality of elongate risers each having a lower end received in a top receptacle of a socket of one panel and an upper end received in a bottom receptacle of a corresponding socket of an adjacently upward panel;

at least one turntable assembly removably supported on the upper surface of one panel of the plurality of panels and rotatable about a generally vertically oriented axis, the at least one turntable having a top storage surface, wherein the at least one turntable assembly is a circular panel and has a center opening through which one of the plurality of risers passes; and a plurality of bearings received in the upper surface of the one panel whereby a bottom surface of the at least one turntable assembly bears against the plurality of bearings.

25. The shelving system of claim 24, further comprising:

one or more depressions formed in the upper surface of the one panel and in which the ball bearings are received.

26. The shelving system of claim 24, further comprising:

a bearing track formed in the upper surface of the one panel and in which the plurality of bearings are received.

27. The shelving system of claim 24, wherein each rear socket is adapted to absorb forces applied thereat by permitting relative movement between a riser received therein and the respective panel.

28. The shelving system of claim 24, wherein the risers are fabricated from a material selected from polyethylene, polypropylene, and polystyrene.

29. The shelving system of claim 24, wherein the upper surface of each of the plurality of panels is non-perforated.

30. The shelving system of claim 24, wherein each of the plurality of panels has structural ribs.

31. The shelving system of claim 24, wherein the upper surface of each of the plurality of panels forms an open grid pattern.

* * * * *

UNITED STATES PATENT AND TRADEMARK OFFICE

CERTIFICATE OF CORRECTION

PATENT NO. : 6,908,000 B2
DATED : June 21, 2005
INVENTOR(S) : Clark et al.

It is certified that error appears in the above-identified patent and that said Letters Patent is hereby corrected as shown below:

Column 9,
Lines 8 and 15, delete “toy” and insert -- top --.

Signed and Sealed this

Twentieth Day of December, 2005

JON W. DUDAS
*Director of the United States Patent and Trademark Office*